US008408546B2

(12) United States Patent
Jones

(10) Patent No.: US 8,408,546 B2
(45) **Date of Patent: *Apr. 2, 2013**

(54) METHOD OF ASSIGNING A TEMPORARY BANKER FOR A GAME OF CHANCE

(75) Inventor: Mark Hamilton Jones, Paradise, CA (US)

(73) Assignee: Mark H. Jones, Minden, NV (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/196,048

(22) Filed: Aug. 2, 2011

(65) Prior Publication Data

US 2011/0278793 A1 Nov. 17, 2011

Related U.S. Application Data

(63) Continuation of application No. 12/562,545, filed on Sep. 18, 2009, now Pat. No. 8,042,810.

(60) Provisional application No. 61/192,493, filed on Sep. 19, 2008.

(51) Int. Cl.
*A63B 71/00* (2006.01)

(52) U.S. Cl. ..... 273/142 R

(58) Field of Classification Search ..... 273/142 R
See application file for complete search history.

(56) References Cited

U.S. PATENT DOCUMENTS 3,810,627 A 5/1974 Levy
3,909,002 A 9/1975 Levy
5,294,128 A * 3/1994 Marquez ..... 273/292
5,476,259 A 12/1995 Weingardt
5,476,265 A * 12/1995 Miller et al. ..... 273/292
5,529,309 A * 6/1996 Bartlett ..... 273/292
5,540,444 A 7/1996 Nguyen
5,741,012 A * 4/1998 So et al. ..... 273/292
5,788,241 A * 8/1998 Ung ..... 273/292
5,813,912 A 9/1998 Shultz
5,823,536 A 10/1998 Flasch
5,871,213 A * 2/1999 Chadband et al. ..... 273/292
5,879,007 A * 3/1999 Kasri ..... 273/292
5,961,384 A * 10/1999 Robinson ..... 463/10
6,039,649 A * 3/2000 Schulze ..... 463/16
6,070,872 A * 6/2000 Squitieri ..... 273/292
6,575,831 B1 6/2003 Gonen et al.
6,582,301 B2 * 6/2003 Hill ..... 463/11
6,659,866 B2 12/2003 Frost et al.
6,769,693 B2 * 8/2004 Huard et al. ..... 273/274
6,916,245 B1 * 7/2005 Vancura et al. ..... 463/26
6,932,707 B2 * 8/2005 Duhamel ..... 463/42
7,070,505 B2 * 7/2006 Vancura et al. ..... 463/25
7,344,440 B2 3/2008 Gonen et al.
7,575,236 B1 * 8/2009 Haber ..... 273/292
(Continued)

*Primary Examiner* — Kurt Fernstrom
*Assistant Examiner* — Dolores Collins
(74) *Attorney, Agent, or Firm* — Dickinson Wright PLLC

(57) ABSTRACT

A roulette-style game of chance which is played using a player-banked system. The role of temporary Banker is randomly offered to one of the player positions (12-22). If a player is not available or willing to accept the role, a licensed Banker is appointed as temporary Banker and game play begins. Once a game decision is reached, wagers are resolved according to pre-established wager resolution priorities with pay-outs being resolved before collections. In situations where a player acts as temporary Banker, other players may bank behind the temporary Banker by placing supplemental value at risk. A player acting as temporary Banker, and any players banking behind the temporary Banker, are not permitted to pay out and collect more than the aggregated amount of value they have placed at risk. Once a pre-determined number of games of chance have been played and resolved in this manner, the role of temporary Banker is offered to another player so that all players have an equal chance of participating in the role of temporary Banker.

20 Claims, 9 Drawing Sheets

U.S. PATENT DOCUMENTS

| | | | | |
|---|---|---|---|---|
| 7,693,778 | B2 * | 4/2010 | Nafeh | 705/37 |
| 2002/0043763 | A1 * | 4/2002 | Lorenzin | 273/274 |
| 2005/0266919 | A1 | 12/2005 | Rowe et al. | |
| 2006/0084505 | A1 | 4/2006 | Yoseloff et al. | |
| 2007/0026930 | A1 | 2/2007 | Frost et al. | |
| 2008/0073842 | A1 | 3/2008 | Jones | |
| 2008/0085772 | A1 | 4/2008 | Iddings et al. | |
| 2008/0265504 | A1 | 10/2008 | Jones | |

* cited by examiner

| Sample Resolution Priority | Bet Name | Winning Spaces | Payout |
|---|---|---|---|
| 1 | Odd | 1, 3, 5,..., 35 | 1 to 1 |
| 1 | Even | 2, 4, 6,..., 36 | 1 to 1 |
| 1 | Red | 1, 3, 5, 7, 9, 12, 14, 16, 18, 19, 21, 23, 25, 27, 30, 32, 34, 36 | 1 to 1 |
| 1 | Black | 2, 4, 6, 8, 10, 11, 13, 15, 17, 20, 22, 24, 26, 28, 29,31, 33, 35 | 1 to 1 |
| 1 | 1 to 18 | 1, 2, 3,..., 18 | 1 to 1 |
| 1 | 19 to 36 | 19, 20, 21, ....,36 | 1 to 1 |
| 2 | 1st Dozen | 1 through 12 | 2 to 1 |
| 2 | 2nd Dozen | 13 through 24 | 2 to 1 |
| 2 | 3rd Dozen | 25 through 36 | 2 to 1 |
| 2 | 1st Column | 1, 4, 7, 10, 13, 16, 19, 22, 25, 28, 31, 34 | 2 to 1 |
| 2 | 2nd Column | 2, 5, 8, 11, 14, 17, 20, 23, 26, 29, 32, 35 | 2 to 1 |
| 2 | 3rd Column | 3, 6, 9, 12, 15, 18, 21, 24, 27, 30, 33, 36 | 2 to 1 |
| 3 | Six Line | Any Six Numbers from Two Horizontal Rows (1,2,3,4,5,6 or 28,29,30,31, 32,33 etc.) | 5 to 1 |
| 4 | Top Line | 0, 00, 1, 2, 3 | 6 to 1 |
| 5 | Corner | Any Four Adjoining Numbers in a Block (1, 2, 4, 5 or 17, 18, 20, 21 etc. ) | 8 to 1 |
| 6 | Basket | 0, 1, 2 or 00, 2, 3 or 0, 00, 2 | 11 to 1 |
| 6 | Street | Any Three Numbers Horizontal (1, 2, 3 or 4, 5, 6 etc | 11 to 1 |
| 7 | Row 00 | 0, 00 | 17 to 1 |
| 7 | Split | Any Two Adjoining Numbers Vertical or Horizontal | 17 to 1 |
| 8 | 0 | 0 | 35 to 1 |
| 8 | 00 | 00 | 35 to 1 |
| 8 | Straight Up | Any Single Number | 35 to 1 |

FIG. 8

METHOD OF ASSIGNING A TEMPORARY BANKER FOR A GAME OF CHANCE

CROSS REFERENCE TO RELATED APPLICATIONS

This application is a Continuation of U.S. patent application Ser. No. 12/562,545 filed Sep. 18, 2009, which claims priority to U.S. Provisional Application No. 61/192,493 filed Sep. 19, 2008, the entire disclosure of which is hereby incorporated by reference.

BACKGROUND OF THE INVENTION

1. Field of the Invention

This invention relates to a method for playing a game of chance, and more particularly, toward a method for playing a roulette style game in which the role of temporary Banker is randomly offered so that each player has an opportunity to assume the role of temporary Banker.

2. Related Art

The game of roulette is a well established game where the house banks the outcome of a ball dropping into a permanent labeled receiving area on a roulette wheel. There have been other formats of the game designed to use cards in place of the roulette wheel to generate the outcome of the decision point. The use of a house bank has always been a part in all these methods of play.

Some jurisdictions place restrictions on house-banked games of chance. As a result, it is sometimes desirable to alter or adjust the method of game play to provide individual players an opportunity to serve in the role of temporary Banker rather than the house. For example, U.S. Pat. No. 5,823,536 to Flasch describes a blackjack card game in which each player is offered the role of Banker. The Banker collects wagers and settles wagers according to traditional blackjack payoff rules. A vigorish is paid to the house. The Dealer offers each player the chance to be the Banker, starting from a player position adjacent to the Dealer. If this player declines the offer, the position is offered to the next player clockwise consecutively down the line along the table. To accept the role of Banker, the player must be able to cover four times (4×) the wagers of all the players. In a variation of the game, the Dealer or house may act as co-Banker, covering a portion of every payoff that the Banker is required to make.

In another example, U.S. Pat. No. 6,575,831 to Gonen et al. discloses a method for playing casino games (including Roulette) in which players are assigned the role of Banker in order to participate in the more preferable odds traditionally enjoyed by the casino. The Banker role may be offered in a random or structured order to players that have a qualifying banker score. If a Banker lacks sufficient credit to cover the anticipated action, additional sums of money may be added through a credit step so that the player can continue to act in the role of Banker. Otherwise, when the Banker's credit falls below the qualifying level, the player serving as Banker is replaced.

U.S. Pat. No. 5,540,444 to Nguyen discloses a method of playing a card game among eight players together with a Dealer where the role of Banker is rotated from one player to the next. Each player may serve as Banker for two games and then passes the responsibility to the next adjacent player. U.S. Pat. No. 5,476,259 to Weingardt discloses a method for playing pari-mutuel casino games including roulette. The method describes a fairly sophisticated pooling concept so that all wagering action can be covered by players in the context of a pari-mutuel arrangement.

Accordingly, while the prior art has proposed various game-playing methods in which players may be offered the role of temporary Banker, these methods fail to account for the fact that a player may wish to assume the role of temporary Banker but not wish to put at risk an amount of money which is sufficient to cover all of the wager action. Accordingly, there is a need in the art for a revised method for playing a game of chance in which a player is given the opportunity to serve in the role of temporary Banker without putting at risk an amount of money sufficient to cover all wager actions, and simultaneously allowing all wagers to be settled in manner which fully satisfies all players. Furthermore, there is a need in the art to provide for opportunities for players which are not serving in the role of temporary Banker to also put money at risk and thereby bank behind monies posted by the temporary Banker to cover wagering action.

SUMMARY OF THE INVENTION

According to this invention, a method is provided for playing a game of chance comprising the steps of providing a playing surface having a plurality of sequentially ordered player positions and a licensed Banker position distinct from each of the player positions. One or more players are stationed at each of the respective player positions. A licensed Banker is permanently stationed at the licensed Banker position. A temporary Banker is selected by first randomly offering the role of temporary Banker to one of the player positions, then contingently offering the role of temporary Banker to the next sequential player position if the preceding player position is vacant or if a player at the preceding player position refuses the temporary Banker role. This step of contingently offering the role temporary Banker to the next sequential player position is repeated as needed until such time as a player accepts the offer to be temporary Banker or the player residing in the player position closest to the last player position in the sequential order refuses the temporary Banker role, whichever occurs first. Once a temporary Banker is selected, wagers are placed on the outcome of the game of chance, and then the game of chance is played. A game decision is obtained and then wagers are resolved by, at least in part, the temporary Banker. The role of temporary Banker is then contingently offered to the next sequential player position, with this step being repeated, as needed, until such time as a different player accepts the offer to be temporary Banker or the player residing in the player position closest to the last player position in the sequential order refuses the temporary Banker role, whichever occurs first. Once a new temporary Banker is selected, the steps of placing wagers, playing the game, obtaining a game decision and resolving wagers are repeated so that game play may continue with all players being given an opportunity to serve as temporary Banker.

In more specific embodiments of the invention, the step of selecting a temporary Banker from among the players and licensed Banker includes appointing the licensed Banker to the role of temporary Banker if the player residing in the player position closest to the last player position in the sequential order is offered but refuses the temporary Banker role. The temporary Banker is required to post value at risk to cover at least a portion of the wager action, and solicitations are made to other players to post supplemental value at risk to cover additional portions of the wager action. Wagers are resolved according to a pre-established wager resolution priority which includes grouping all wagers of the same pay-out ratio with the same wager resolution priority. The licensed Banker is required to cover all wagers in excess of the amount of value placed at risk during the posting and soliciting steps.

In this manner, if the temporary Banker together with any other player backing fails to satisfy all wager action, the licensed Banker assures that all wagers are fully and completely resolved according to the normal rules of play.

The subject invention overcomes the shortcomings and disadvantages evident in prior art game methods by allowing a player to assume the role of temporary Banker by putting at risk an amount which may not be sufficient to cover all of the wagering action. Other players may bank behind the temporary Banker and take on supplemental risk to resolve wagers once the temporary Banker's funds have been matched by wager action. The subject game method provides an entertaining and novel method for playing games of chance which will be appealing to those involved in game play and the gaming trade.

BRIEF DESCRIPTION OF THE DRAWINGS

These and other features and advantages of the present invention will become more readily appreciated when considered in connection with the following detailed description and appended drawings, wherein:

FIG. 8 is a sample pay table for a roulette-styled game of chance showing a wager resolution priority for the various wager options.

DETAILED DESCRIPTION OF THE PREFERRED EMBODIMENT

Figure 1:
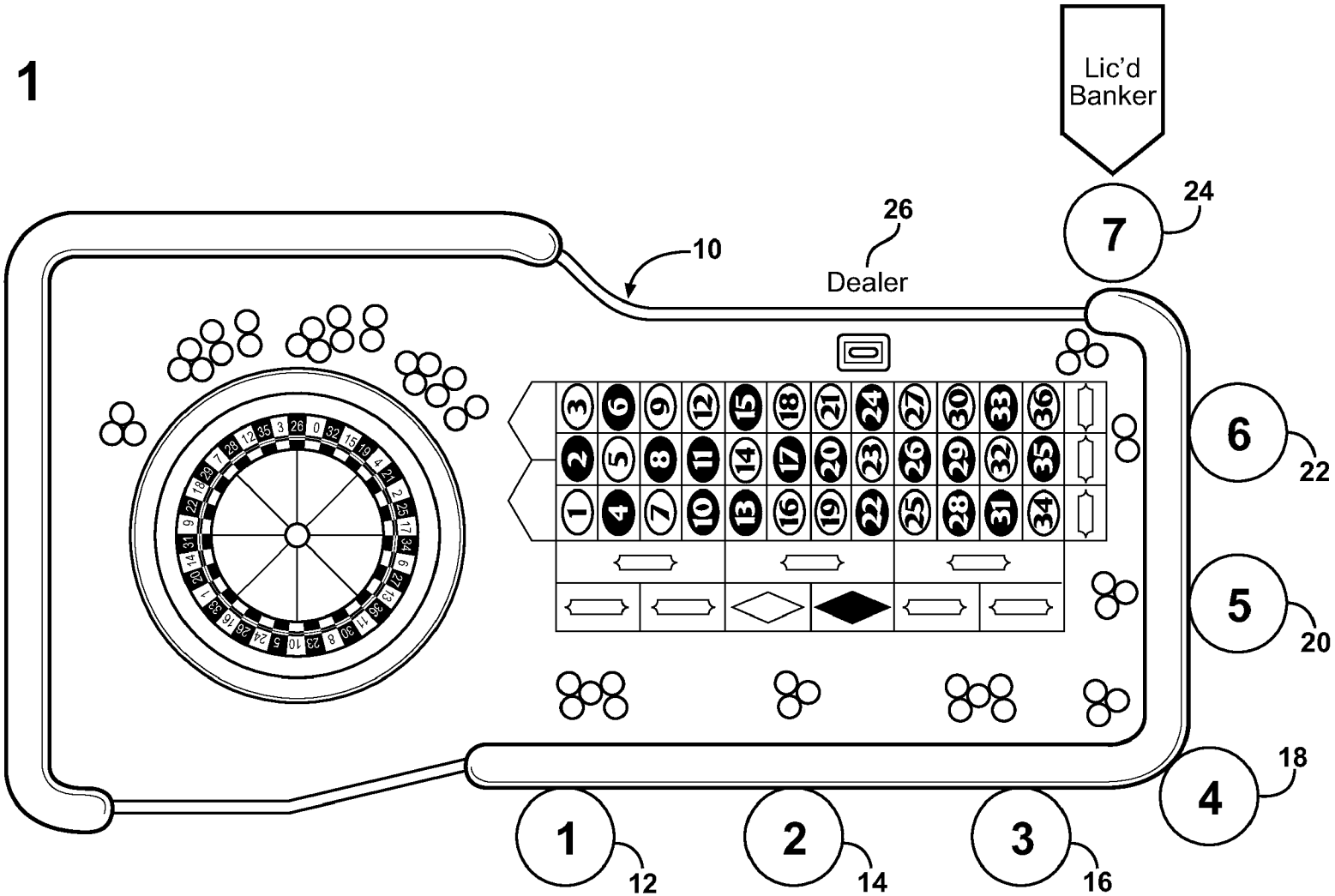
FIG. 1 is a top view of a roulette-style table game including a table game layout consistent with the traditional game of roulette and a roulette decision wheel.

Referring to the Figures, wherein like numerals indicate like or corresponding parts throughout the several views, a playing surface for a roulette-style game of chance is generally shown at 10. The playing surface 10 may be of the physical, 3-dimensional type associated with the generally horizontal game table as shown in FIG. 1, or in the alternative, may comprise merely a visual representation of a roulette or roulette-style game of chance projected or otherwise manifested on a display screen or in a display space. As is typical with most roulette-style games of chance, a wagering area may provide a bet selection region capable of receiving markers, chips or other indicia in which a player forecasts an expected game decision which simultaneously places a specified sum or value at risk. A variety of betting options are typical in the game of roulette including bets placed on specific numbers, colors, groups of numbers and the like, as will be described in greater detail.

A number generator for the game of chance may comprise the traditional roulette wheel which is a horizontally disposed and has 37 or 38 numbered pockets. To determine a winning number or color, the wheel is spun in one direction and a small, marble-like ball is circulated in an opposite direction. The ball eventually loses momentum and seats in a pocket corresponding to one of the 37 or 38 numbers on the wheel, thus generating a game decision. Alternative number generation devices have been proposed and may be used in connection with this game method, including the Applicant's own card-wheel device as described in US Publication No. 2008/0073842, published Mar. 27, 2008, the entire disclosure of which is hereby incorporated by reference. A random number generator (RNG) may be used to generate and display a decision number rather than a roulette wheel, card wheel or the like. Furthermore, ball blowers such as typically found in lottery style games may be used, as shown in US Publication No. 2008/0265504, published Oct. 30, 2008, the entire disclosure of which is hereby incorporated by reference.

A plurality of sequentially ordered player positions 12-22 are arranged around the playing surface. A licensed Banker position 24 is also provided relative to the playing surface. In the example illustrated in FIG. 1, up to 6 players can be stationed about the playing surface 10. No more than one player occupies each player position, and game play may proceed even if one or several of the player positions 12-22 are vacant. In practice, roulette-style games of chance are played one after another in continuum so long as at least one player is present. Normally, players will come and go and successive games will be dealt by a Dealer 26 or Croupier. A licensed Banker is always stationed at the licensed Banker position 24. The term "licensed" Banker is used herein as a title and does not intend to suggest a requirement that the person serving in this capacity is actually licensed by an official authority. While the licensed Banker may be licensed by some state or other regulatory authority, it is not absolutely necessary for purposes of the subject method.

The player positions 12-22 are sequentially ordered one through six, as shown in FIG. 1. Alternatively, the sequential order could be A-F, or any other sequential ordering technique. For purposes of illustration, the licensed Banker position 24 is identified as sequential number 7.

Figure 2:
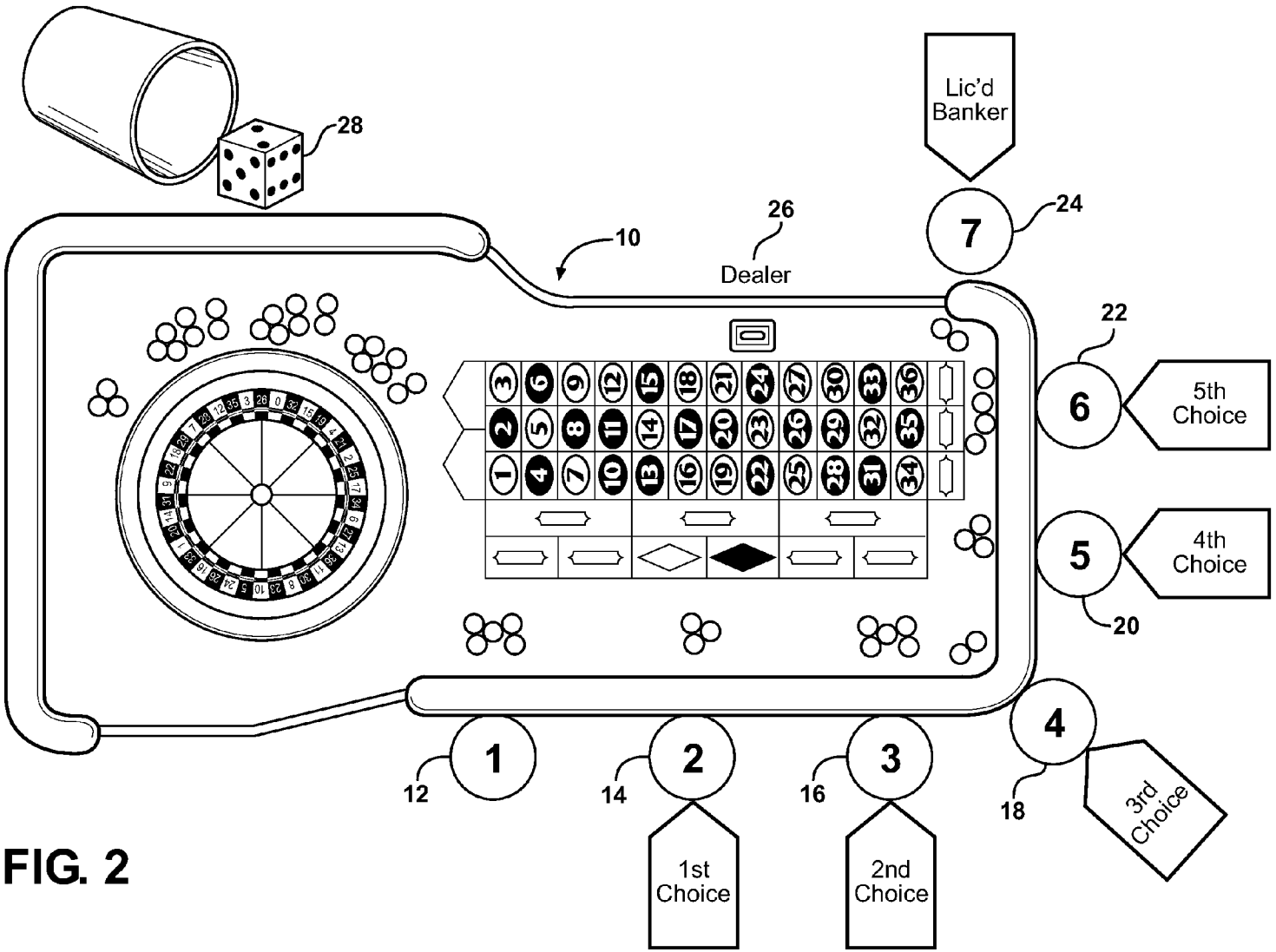
FIG. 2 is a view as in FIG. 1 but depicting the roll of a single die to select a temporary Banker and the order in which contingent offers are made to the various player positions and the licensed Banker.

The subject game method deviates from the traditional rules of roulette by creating an alternative player-banked system which does not affect the basic rules of game play, but does alter to some extent the wager resolution schemes in an entertaining and interesting fashion. In beginning play of the game of chance, a temporary Banker is selected from among the player positions 12-22. More specifically, the role of temporary Banker is offered to one of the player positions using a random selection technique. As shown in FIG. 2, this may comprise rolling a single, standard 6-sided die 28. The number appearing on the die 28 thus establishes the random selection of a player position to whom is first offered the role of temporary Banker.

As shown in FIG. 2, the die 28 has been tossed and generated the number "2" thus signaling that the second player position 14 shall be offered the role of temporary Banker. If player position number 2 is vacant, or if a player residing in the second player position 14 refuses the temporary Banker role, then the next sequential player position is considered, which in this case is the third player position 16. Likewise, if the third player position 16 is vacant or if a player stationed in that player position refuses the role of temporary Banker, then the choice passes sequentially to the fourth player position 18. This step of contingently offering the role of temporary Banker to a particular player position is repeated, as needed, until either one of the two occurrences: a player accepts the offer to be temporary Banker, or the player residing in the player position closest to the last player position 22 refuses the role of temporary Banker. Thus, as shown still in FIG. 2, assuming there are players seated in each of player positions 14-22, this step of making a contingent offer to the next sequential player position is repeated only until such time as the player seated in the sixth player position 22 refuses the role. When this occurs, the licensed Banker is appointed the role of temporary Banker. As will be noted, in this scenario, a player residing at the first player position 12 would not be offered the role of temporary Banker prior to it being appointed to the licensed Banker at the licensed Banker position 24.

Once the temporary Banker has been selected, wagers are placed on the outcome of the game of chance is determined according to the traditional rules of roulette or any modified version thereof in effect. Wagers are resolved by the temporary Banker, and perhaps others, according to methods which will be described subsequently. One or more games of chance may be played in this fashion using the same temporary Banker. However, once a pre-determined number of games have been played, for example two games, the role of temporary Banker is contingently offered to the next sequential player position. Thus, in the example of FIG. 2, if a player residing in the second player position 14 had accepted the initial offer to be temporary Banker, at the conclusion of the designated number of games the player at the second player position 14 must relinquish the role of temporary Banker following which it is offered to the third player position 16. As before, the offer would be contingent upon a player residing at the third player position 16, and upon the player accepting the role of temporary Banker. The step of contingently offering the role of temporary Banker to the next sequential player position is repeated until such time as a different player accepts the offer to be temporary Banker or the player residing in the player position closest to the last player position in the sequential order refuses the temporary Banker role, whichever occurs first.

If the player residing in the player position closest to the last player position 22 refuses the temporary Banker role, the licensed Banker 24 is appointed as temporary Banker and serves in this capacity for the designated number of games which could be as few as one game or as many games as has been established to comply with jurisdictional regulations. If the licensed Banker has last served as temporary Banker, the contingent offer is made to the first player position 12, and then repeated as necessary according to the protocols described.

Figure 3:
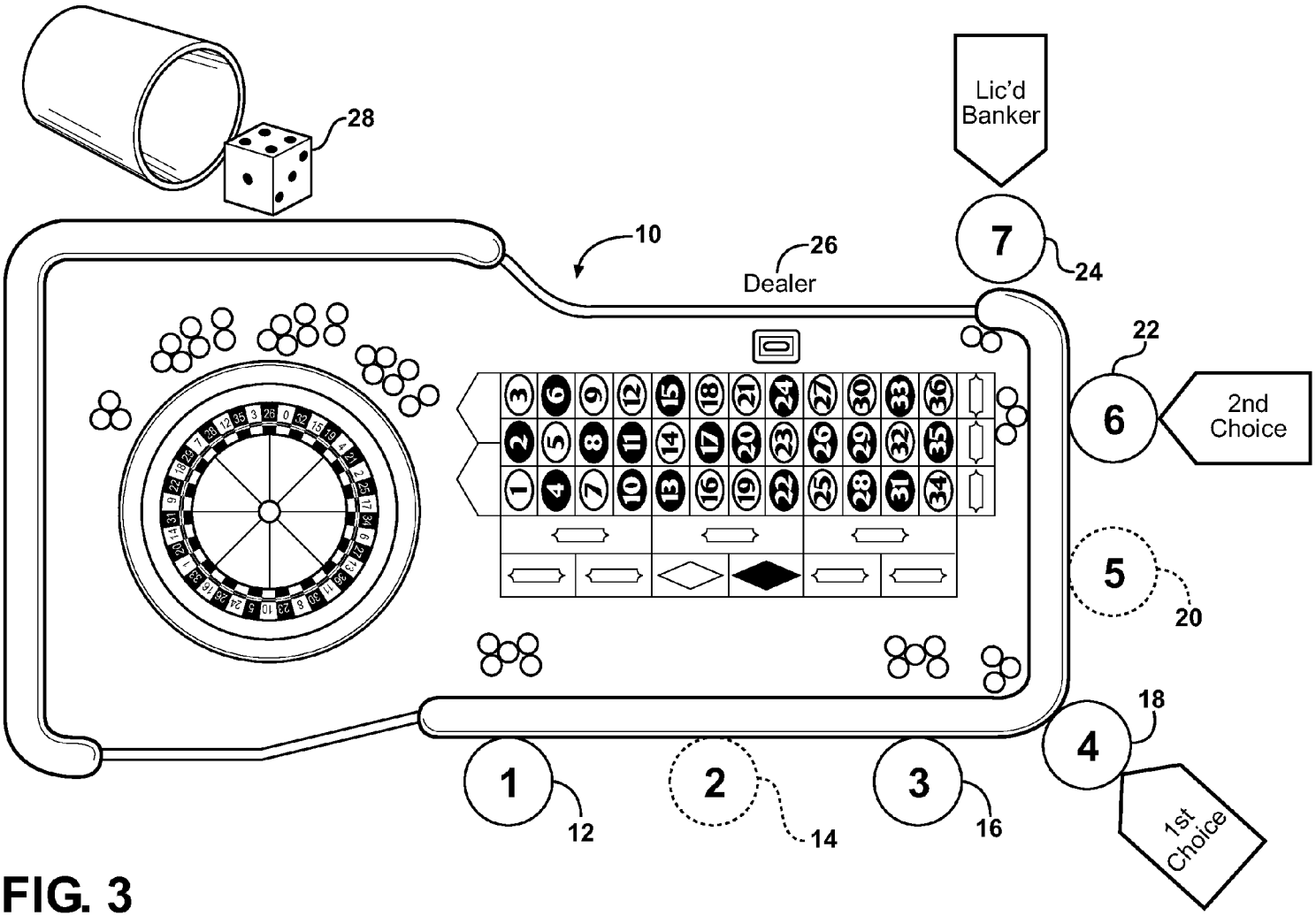
FIG. 3 is a view as in FIG. 2 illustrating a different roll of the die to select a temporary Banker and in which player positions 2 and 5 are vacant.

FIG. 3 illustrates a situation wherein the second 14 and fifth 20 player positions are vacant, as depicted by broken lines at the respective player positions. At the start of play, a temporary Banker is randomly selected by a roll of the die 28, which in this instance produces the number 4, thus passing first choice of the temporary Banker role to the player stationed at the fourth player position 18. If the player declines the role of temporary Banker, second choice is then offered to the player stationed at sixth player position 22. If this player refuses the role of temporary Banker, the licensed Banker is appointed and game play begins. Following the pre-determined number of games played and resolved, the role of temporary Banker will then be offered to the player seated at the first player position 12 and repeated, as necessary, until a different player accepts the offer to be temporary Banker, or the player residing in the player position closest to the last player position 22 (which in this example is the sixth player position 22) refuses the role. It is conceivable that a licensed Banker will serve as temporary Banker for another successive round of games, however it is not intended that one of the players will serve as temporary Banker for more than the pre-determined number of rounds because the licensed Banker will be appointed as the temporary Banker if the player residing in the player position closest to the last player position 22 in the sequential order refuses the temporary Banker role.

Figure 4:
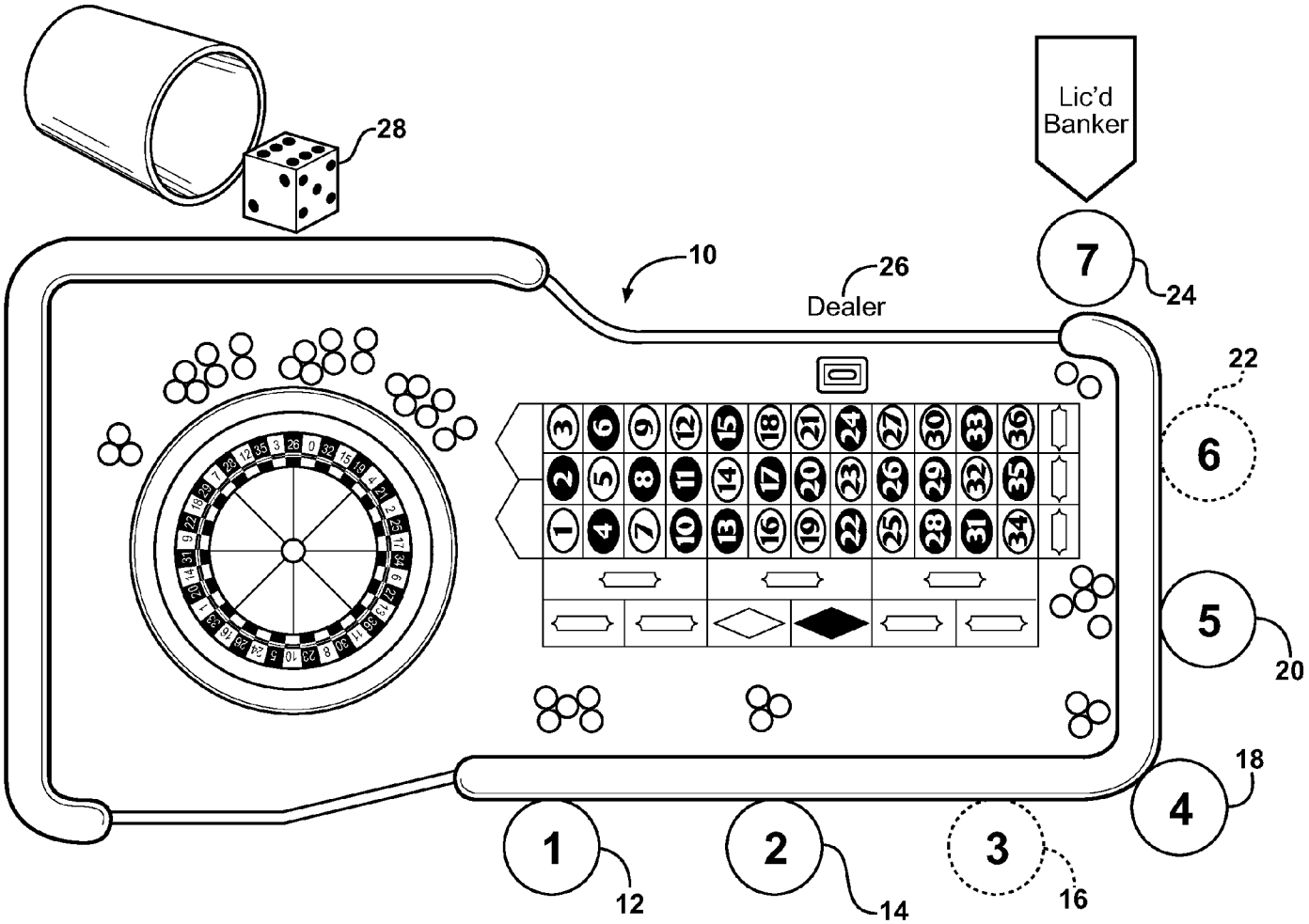
FIG. 4 is a view as in FIG. 2 showing yet another roll of the die to select a temporary Banker in which player positions 3 and 6 are vacant, and as a result, a licensed Banker is directly appointed to the role of temporary Banker.

FIG. 4 illustrates yet another example of game play wherein the step of selecting a temporary Banker passes directly to the licensed Banker. This is because, in this example, the die 28 produces the number 6 and the sixth player position 22 is vacant. Thus, because there is no player to serve as temporary Banker in the sequential order, the role passes directly to the licensed Banker at the licensed Banker position 24. After the pre-determined number of games has been played with the licensed Banker serving as temporary Banker, the role will be offered to the player residing in the first player position 12 according to the rules as described. By this method, game play continues so long as at least one of the player positions 12-22 are filled with a player. Game play stops if there are no players seated at any of the player positions 12-22. When the licensed Banker is not serving as a temporary Banker, the licensed Banker may participate in game play, usually betting the table minimum.

Figure 5:
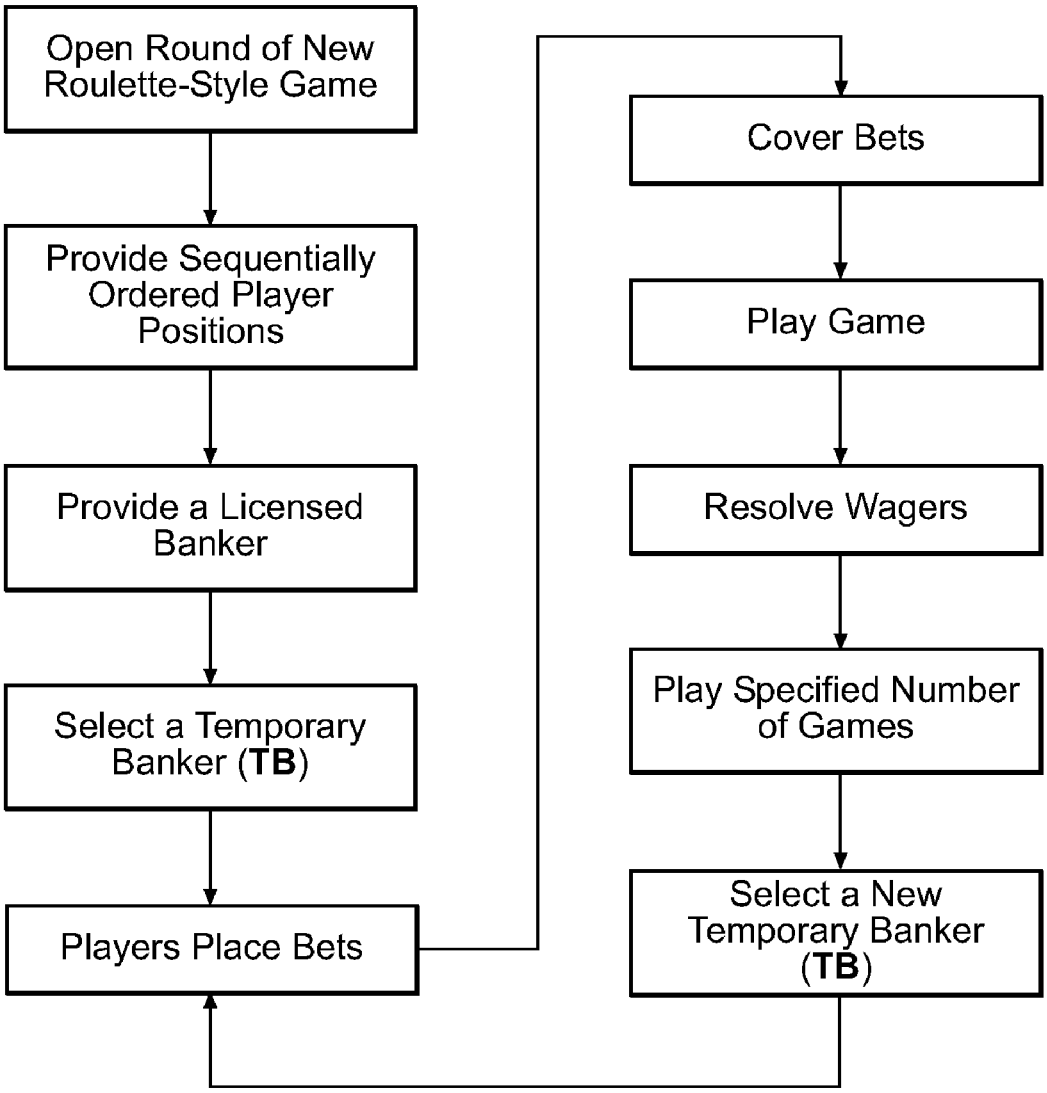
FIG. 5 is a flow chart depicting, in general terms, a method for playing a game of chance according to the subject invention.
Figure 6A:
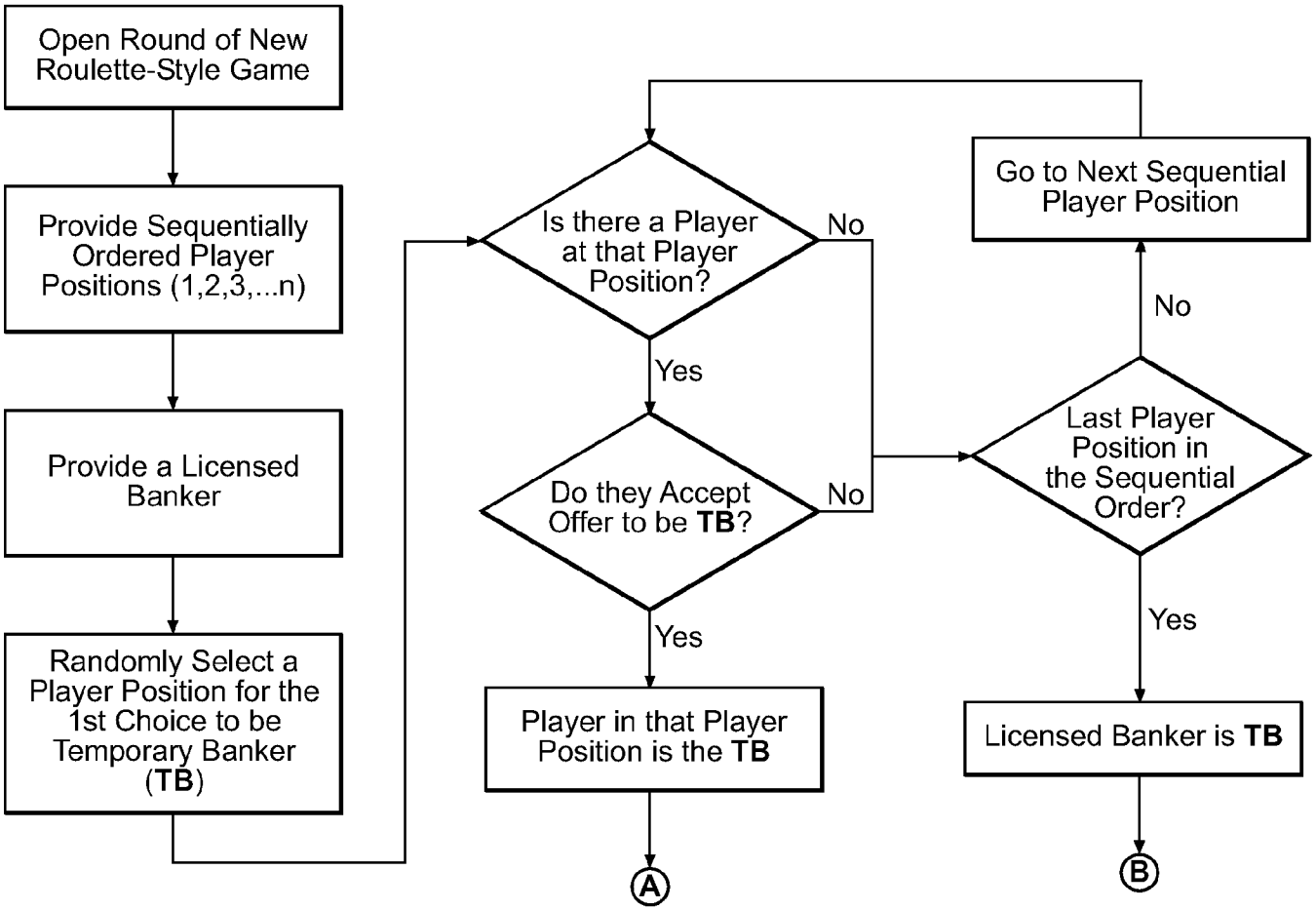
FIGS. 6A & 6B are more detailed flow diagrams illustrating a preferred method for playing the subject game of chance.
Figure 6B:
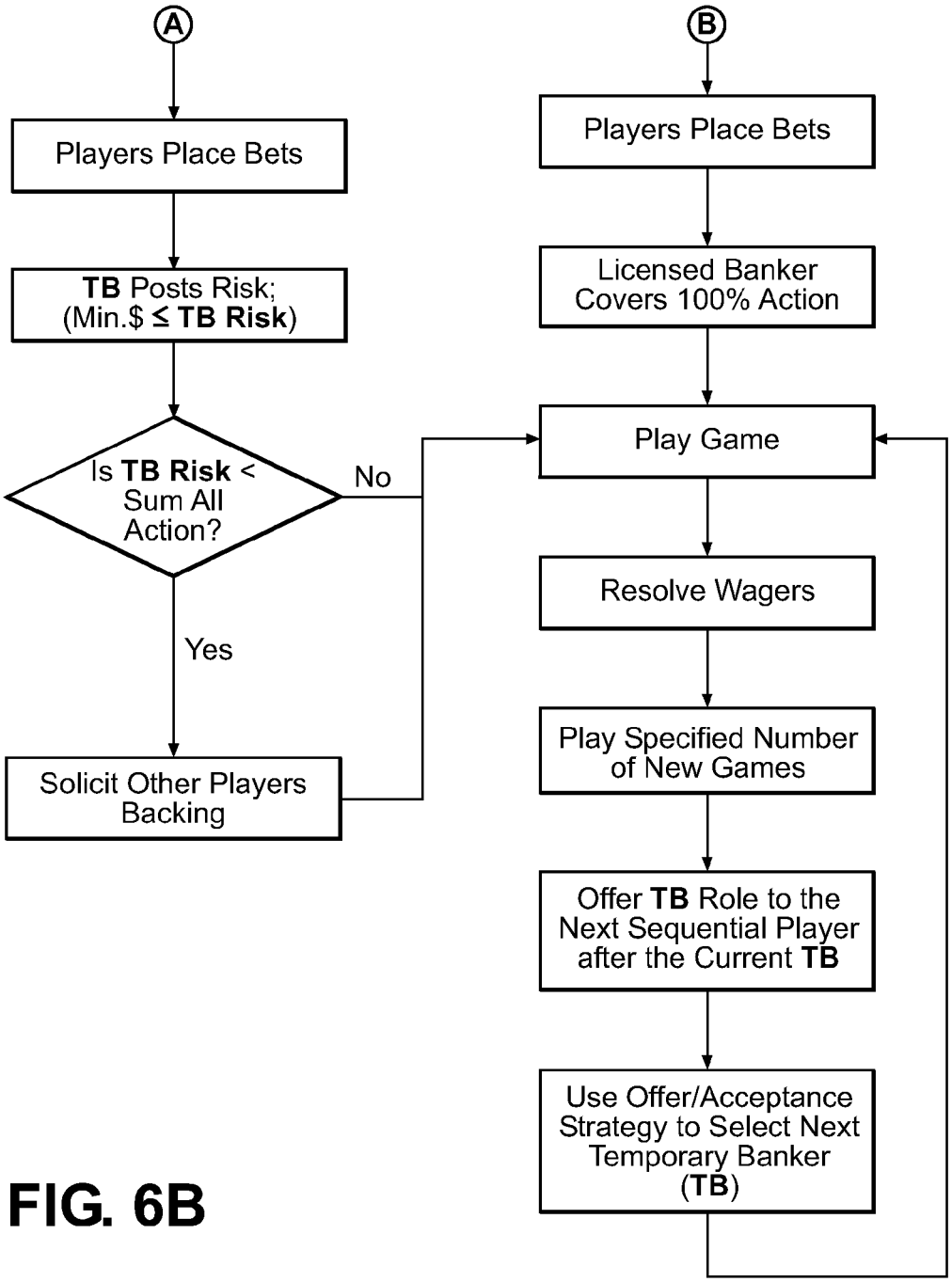

Whenever a player serves as temporary Banker, they are required to post value at risk to cover at least a portion of the wager action. Normally, this posted value at risk will be set at a minimum amount established by the house which, for purposes of illustration, may be $100. The temporary Banker is free to post value at risk greater than the minimum amount, at their discretion. Some players, when serving as temporary Banker, may prefer to post much more value at risk than the minimum required so as to participate in the generally more favorable house odds. When resolving wagers, the temporary Banker is restricted from paying out and collecting an aggregated amount greater than the amount of value they have placed at risk, so that placing greater sums at risk will enable them to participate in a larger portion of the total action. In situations where the temporary Banker has not posted value at risk sufficient to cover all of the wager action, other players may be solicited to post supplemental value at risk and thereby cover further portions of the wager action. As with the restriction placed on the temporary Banker, however, the other players who bank behind the temporary Banker will also be restricted from paying out and collecting an aggregated amount greater than the amount of value they have placed at risk. Thus, if another player has banked $50 behind the temporary Banker, that player will only be able to participate in wager resolution (pay-outs and collections combined, totaling $50). The licensed Banker will always cover all wagers in excess of the amounts of value placed at risk by the temporary Banker and any other players posting supplemental value, so that in every case, all wagers are resolved completely and according to the established pay-out tables. The steps of posting value at risk and soliciting other players to back behind the temporary Banker are described further with reference to FIGS. 5 & 6A-6B.

Figure 7:
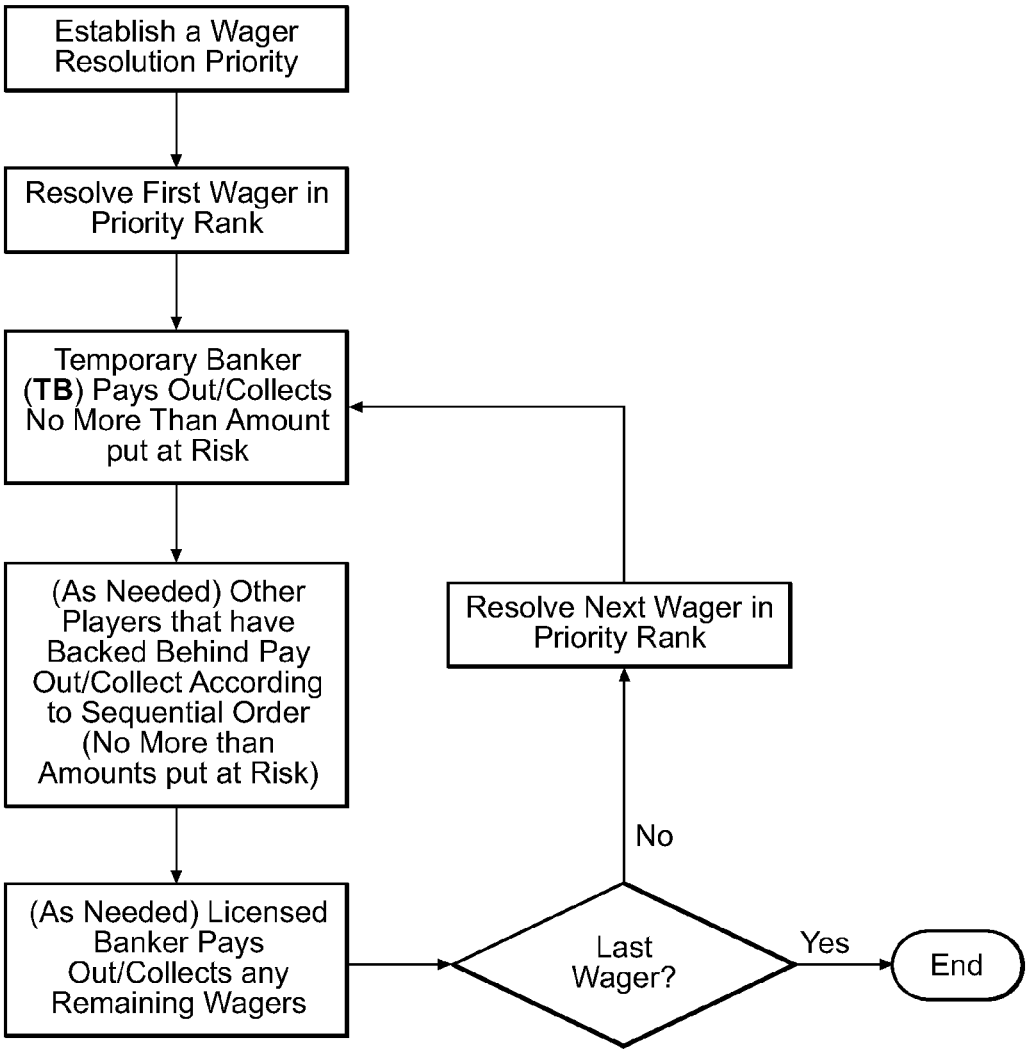
FIG. 7 is a flow diagram of a method for resolving wagers according to one embodiment of this invention.

Referring now to FIGS. 7 and 8, the wager resolution steps are described in further detail. Preferably, all available wagers are assigned a particular wager resolution priority. For example, FIG. 8 shows how wager resolution priorities may be structured so that all wager types having the same pay-out ratio will be grouped together. In other words, all wagers having a pay-out ratio of 1 to 1 may be set as resolution priority one. This would typically include odd and even numbered bets, colored bets (in a 2-color system), as well as bets on numbers 1-18 vs. 19-36. All bets having a pay-out ratio of 2 to 1 are grouped as the second resolution priority, the single 5 to 1 bet ("6 Line") has a third resolution priority. The "Top Line" bet having a pay-out ratio of 6 to 1 is set as the fourth resolution priority, and so forth. Alternatively, the groupings could be reversed so that bets having the highest pay-out ratio, e.g., 35 to 1, are grouped and set as the first resolution priority, etc.

FIG. 7 illustrates an exemplary flow chart according to one aspect of the subject method in which, at the time of wager resolution, the temporary Banker is required to pay out winning wagers and may collect losing wagers. As stated previously, the temporary Banker may pay out and collect no more than the amount they have put at risk. Therefore, if they have put $100 at risk, they must stop paying out and/or collecting on wagers once, in the aggregate, they have settled action equating to $100. Optionally, priority is given to resolving pay-outs before collections so that the temporary Banker must pay out on winning wagers of a given priority level prior to collecting losing player wagers. Therefore, in the example set forth above wherein the temporary Banker has placed $100 value at risk and in which there are first level priority winning wagers totaling $100 and first level priority losing wagers totaling $500, the temporary Banker will be required to resolve the pay-out of $100 first, thereby consuming his entire amount at risk and being precluded to participate in any of the collections. When this occurs, players which have banked behind the temporary Banker, if any, will proceed to pay out and/or collect according to their sequential order but no more than the amounts they have put at risk. Once the temporary Banker and all other players who have banked behind have participated in wager action equivalent to the amounts they have put at risk, respectively, the licensed Banker will pay out and then collect any still remaining wagers. Another example of the wager resolution steps may be had by considering the scenario in which four players playing the game of chance have each posted bets as shown below:

Bet 1/priority level 1=$20 (pay-out=5:1)

Bet 2/priority level 2=$100 (pay-out=2:1)

Bet 3/priority level 2=$50 (pay-out=2:1)

Bet 4/priority level 3=$100 (pay-out=1:1)

In this example, the temporary Banker is a player, i.e., not the licensed Banker, and has placed $100 at risk. One other player has chosen to bank behind the temporary Banker and has posted value equal to $50. The game is played and as a result Bet 1 wins whereas Bets 2, 3, and 4 each lose. Wagers are resolved as follows:

Bet #1 wins and the player is owed $100. The $100 is paid entirely from the temporary Banker's money at risk and as a result the temporary Banker no longer has any remaining action possibilities.

Bet #2 loses $100. Of these loses, the player which has banked behind the temporary Banker receives $50 and no more because they only put $50 at risk. The remaining $50 collected from Bet #2 is paid to the licensed Banker. The monies collected from Bets 3 and 4 are paid entirely to the licensed Banker.

In another example, the same Bets 1-4 are placed, in the same amounts with the same priority rankings and pay-out ratios. The temporary Banker has again put $100 at risk and one other player has banked behind the temporary Banker by placing $50 at risk, as in the preceding example. In this new example, however, Bet #1 loses and Bets 2, 3, and 4 win. Wagers are resolved as follows:

Bet #1 loses $20 and this $20 collection goes to the temporary Banker. The temporary now has $80 worth of action remaining.

Bet #2 wins $100. Of the pay-out, $80 is paid from the temporary Banker's at risk money and the remaining $20 is paid from the other player's at risk money that banked behind the temporary Banker. At this stage, the temporary Banker no longer has any action remaining, and the other player who banked behind the temporary Banker has $30 worth of action remaining.

Bet #3 wins $100, $30 of which is paid from the remaining amount of the other players' money who banked behind the temporary Banker. The remaining pay-out of $70 comes from the licensed Banker. Bet #4 wins $100, and this money is paid entirely from the licensed Banker.

Those of skill in the art will envision many variations of game play without departing from the spirit of this method. For example, either European or American roulette rules can be used, based on the preferred negative player expectation established for a particular proprietor. This specific indices used on the roulette wheel, or cards or other decision generating device are not relevant so long as they mirror all indices printed on the playing surface 10. The casino or proprietor may entertain a varied format wherein three colors (e.g., red, black, and yellow) are established rather than the traditional 2-color layout (red and black). In this varied example, the player may be extended the opportunity to bet on 3 colors with each dozen representing a different color and paying 2 to 1 instead of even money. As an example, decision numbers 1-12 may be associated with the color red, indices 13-24 associated with the color black and indices 25-36 associated with the color yellow. The $37^{th}$ and $38^{th}$ indices (or just the $37^{th}$ indice if playing European style) will have no effect on any color bet as in the traditional game. If a player places a color bet in the $37^{th}$ or $38^{th}$ indice as generated, the color wager loses as would be expected. Color bets may also be based on a column indices instead of a dozen indices.

The subject invention describes a variation in the play of roulette and roulette-styled games in which, at the beginning of game play, the opportunity to bank the game is offered to different players. Players are not required to bank the game but are given an equal opportunity to do so if they choose. A licensed Banker is made available for every play of the game to act as Banker if no player chooses to take on the full level of risk. The temporary Banker is not offered an opportunity to bank the game unless they are in a position after the shake of the die 28 and they are next in line and there is either no player in that player position 12-22 or that person chooses not to bank. In the preferred embodiment the Dealer 26 determines who will be offered the role of temporary Banker by shaking a die 28, or other methods of randomly determining who should be first offered the role may be used.

When the game according the subject method is played in a licensed casino, the casino may charge a fee based on the amount of money wagered by the players and a fee to the temporary Banker. These fees may be set by the casino or house based on market rates. The licensed Banker may post their bank in the area normally reserved for the casino's bank in a traditional casino. Preferably, the house will own the non-value chips as well as the valued checks in the house bank. Such a format allows the players to cash in their non-valued chips right at the table. If a chip leaves the table, it will never charge a value worth more than a specified amount, for example $1. The chips may then be excluded from being cashed in at the casino cage. Thus, when a player acting as temporary Banker puts $100 at risk, they do so by transferring $100 in their colored chips. The Dealer then converts those chips to value checks and pays-out in value checks. When the licensed Banker serves as temporary Banker, pay-outs may done in chips when possible.

Thus, players will place their wagers on the indices or combination of indices that they predict will be consistent with the game decision. The Dealer 26, who is typically a person hired by the casino to handle all transactions, runs the game. All transactions are handled by the Dealer 26. All wagers available in a standard game of roulette are envisioned to be offered to players of games played according to the subject method. After wagers are placed, the Dealer 26 calls "no more bets" and waves off all additional wagers by moving his right hand right to left and back again. This notifies a temporary Banker that the betting cycle is closed and that it is time to watch the action on the game. The Dealer 26 marks the portion of the playing surface 10 associated with the number selection, typically using a Dolly Marker. All bets are settled based on the casino rules and the Dolly Marker is removed indicating that the next round of betting may now begin. When an automated shuffler is used for the purpose of obtaining a game decision, it is preferable that two sets of cards are available so that one is always in the mixing mode while the other is in use.

The foregoing invention has been described in accordance with the relevant legal standards, thus the description is exemplary rather than limiting in nature. Variations and modifications to the disclosed embodiment may become apparent to those skilled in the art and fall within the scope of the invention.

What is claimed is:

1. A method for playing a game of chance, said method comprising:

providing a roulette playing surface (10) having a plurality of sequentially ordered player positions (12-22) and a licensed banker position (24) distinct from each of the player positions (12-22);

providing a roulette wagering area on the roulette playing surface that includes discrete spaces corresponding to a plurality of predetermined numbers;

providing a roulette number generation device adjacent the roulette playing surface that is configured to select one of the plurality of predetermined numbers;

providing one or more players stationed one each at a respective player position;

providing a licensed banker permanently stationed at the licensed banker position (24);

selecting a temporary banker including the steps of:

a) randomly offering the role of temporary banker to one of the player positions;

b) contingently offering the role of temporary banker to the next sequential player position if the preceding player position is vacant or if a player at the preceding player position refuses the temporary banker role; and c) repeating said step of contingently offering the role of temporary banker to the next sequential player position as needed until such time as a player accepts the offer to be temporary banker or the player residing in the player position closest to the last player position in the sequential order refuses the temporary banker role, whichever occurs first;

placing wagers on the outcome of a game of chance;

playing the game of chance;

obtaining a game decision;

resolving the wagers;

contingently offering the role of temporary banker to the next sequential player position;

repeating said step of contingently offering the role of temporary banker to the next sequential player position until such time as a different player accepts the offer to be temporary banker or the player residing in the player position closest to the last player position in the sequential order refuses the temporary banker role, whichever occurs first;

and then repeating said steps of placing wagers, playing the game, obtaining a game decision and resolving the wagers;

further including the step of appointing the licensed banker to the role of temporary banker if the player residing in the player position closest to the last player position in the sequential order refuses the temporary banker role;

wherein said step of selecting a temporary banker includes posting value at risk to cover at least a portion of the wager action, and wherein said step of resolving the wagers includes restricting the temporary banker from paying out and collecting an aggregated amount greater than the amount of value placed at risk during said posting step; and wherein said step of selecting a temporary banker includes the step of soliciting other players to post supplemental value at risk to cover at least a portion of the wager action, and wherein said step of resolving the wagers includes restricting the other players from paying out and collecting an aggregated amount greater than the amount of value placed at risk during said soliciting step; and wherein said step of resolving the wagers includes requiring the licensed banker to cover all wagers in excess of the amounts of value placed at risk during said posting step and said soliciting step.

2. The method of claim 1 wherein said step of resolving the wagers includes establishing a wager resolution priority.

3. The method of claim 2 wherein said step of establishing a wager resolution priority includes resolving pay-outs before collections.

4. The method of claim 1 wherein said step of providing a roulette playing surface (10) includes providing a generally horizontal game table.

5. The method of claim 1 wherein said step of resolving the wagers includes grouping all wager of the same pay-out ratio with the same wager resolution priority.

6. The method of claim 5 wherein said step of grouping all wager of the same pay-out ratio with the same wager resolution priority includes setting primary resolution priority to pay-outs with the lowest pay-out ratio and setting descending resolution priority to pay-outs in descending pay-out ratio order.

7. The method of claim 1 wherein the number generation device is a roulette wheel.

8. The method of claim 1, wherein the number generation device is a card wheel device.

9. The method of claim 1, wherein the number generation device is a random number generator.

10. A method for playing a roulette-style game of chance, said method comprising:

providing a roulette playing surface (10) having a plurality of sequentially ordered player positions (12-22) and a licensed banker position (24) distinct from each of the player positions (12-22);

providing a roulette wagering area on the roulette playing surface that includes discrete spaces corresponding to a plurality of predetermined numbers;

providing a roulette number generation device adjacent the roulette playing surface that is configured to select one of the plurality of predetermined numbers;

providing one or more players stationed one each at a respective player position;

providing a licensed banker permanently stationed at the licensed banker position;

selecting a temporary banker including the steps of:

a) randomly offering the role of temporary banker to one of the player positions;

b) contingently offering the role of temporary banker to the next sequential player position if the preceding player position is vacant or if a player at the preceding player position refuses the temporary banker role;

c) repeating said step of contingently offering the role of temporary banker to the next sequential player position as needed until such time as a player accepts the offer to be temporary banker or the player residing in the player position closest to the last player position in the sequential order refuses the temporary banker role, whichever occurs first; and d) appointing the licensed banker to the role of temporary banker if the player residing in the player position closest to the last player position in the sequential order refuses the temporary banker role;

placing wagers on the outcome of a roulette-style game of chance;

playing the game of chance;

obtaining a game decision;

resolving the wagers;

contingently offering the role of temporary banker to the next sequential player position;

repeating said step of contingently offering the role of temporary banker to the next sequential player position until such time as a different player accepts the offer to be temporary banker or the player residing in the player position closest to the last player position in the sequential order refuses the temporary banker role, whichever occurs first;

and then repeating said steps of placing wagers, playing the game, obtaining a game decision and resolving the wagers;

wherein said step of selecting a temporary banker includes posting value at risk to cover at least a portion of the wager action, and wherein said step of resolving the wagers includes restricting the temporary banker from paying out and collecting an aggregated amount greater than the amount of value placed at risk during said posting step; and wherein said step of selecting a temporary banker includes the step of soliciting other players to post supplemental value at risk to cover at least a portion of the wager action, and wherein said step of resolving the wagers includes restricting the other players from paying out and collecting an aggregated amount greater than the amount of value placed at risk during said soliciting step; and wherein said step of resolving the wagers includes requiring the licensed banker to cover all wagers in excess of the amounts of value placed at risk during said posting step and said soliciting step.

11. The method of claim 10 wherein said step of resolving the wagers includes establishing a wager resolution priority.

12. The method of claim 10 wherein said step of resolving the wagers includes grouping all wagers of the same pay-out ratio with the same wager resolution priority.

13. The method of claim 12 wherein said step of grouping all wager of the same pay-out ratio with the same wager resolution priority includes setting primary resolution priority to pay-outs with the lowest pay-out ratio and setting descending resolution priority to pay-outs in descending pay-out ratio order.

14. The method of claim 13 wherein said step of establishing a wager resolution priority includes resolving pay-outs before collections.

15. The method of claim 10, wherein the number generation device is a roulette wheel.

16. The method of claim 10, wherein the number generation device is a card wheel device.

17. The method of claim 10, wherein the number generation device is a random number generator.

18. A method for playing a roulette-style game of chance, said method comprising the steps of:

providing a roulette playing surface (10) having a plurality of sequentially ordered player positions (12-22) and a licensed banker position (24) distinct from each of the player positions (12-22);

providing a roulette wagering area on the roulette playing surface that includes discrete spaces corresponding to a plurality of predetermined numbers;

providing a roulette number generation device adjacent the roulette playing surface that is configured to select one of the plurality of predetermined numbers;

providing a plurality of players stationed one each at a respective player position;

providing a licensed banker permanently stationed at the licensed banker position (24);

selecting a temporary banker from among the players and licensed banker including the steps of:

a) randomly offering the role of temporary banker to one of the player positions;

b) contingently offering the role of temporary banker to the next sequential player position if the preceding player position is vacant or if a player at the preceding player position refuses the temporary banker role;

c) repeating said step of contingently offering the role of temporary banker to the next sequential player position as needed until such time as a player accepts the offer to be temporary banker or the player residing in the player position closest to the last player position in the sequential order refuses the temporary banker role, whichever occurs first;

d) appointing the licensed banker to the role of temporary banker if the player residing in the player position closest to the last player position in the sequential order refuses the temporary banker role;

e) posting value at risk to cover at least a portion of the wager action; and f) soliciting other players to post supplemental value at risk to cover at least a portion of the wager action;

placing wagers on the outcome of a roulette-style game of chance;

playing the game of chance;

obtaining a game decision;

resolving the wagers according to a pre-established wager resolution priority, the pre-established wager resolution priority including grouping all wagers of the same pay-out ratio with the same wager resolution priority, and further requiring the licensed banker to cover all wagers in excess of the amounts of value placed at risk during said posting step and said soliciting step;

contingently offering the role of temporary banker to the next sequential player position;

repeating said step of contingently offering the role of temporary banker to the next sequential player position until such time as a different player accepts the offer to be temporary banker or the player residing in the player position closest to the last player position in the sequential order refuses the temporary banker role, whichever occurs first;

and then repeating said steps of placing wagers, playing the game, obtaining a game decision and resolving the wagers.

19. The method of claim 18, wherein the number generation device is a roulette wheel.

20. The method of claim 18, wherein the number generation device is a card wheel device.

* * * * *